US006633205B2

(12) United States Patent
Jussaume et al.

(10) Patent No.: US 6,633,205 B2
(45) Date of Patent: Oct. 14, 2003

(54) CASCADED CIRCULATORS WITH COMMON FERRITE AND COMMON ELEMENT MATCHING STRUCTURE

(75) Inventors: Raymond G. Jussaume, Somerville, MA (US); George W. Hempel, Hanson, MA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/067,605

(22) Filed: Feb. 4, 2002

(65) Prior Publication Data

US 2003/0030502 A1 Feb. 13, 2003

Related U.S. Application Data

(60) Provisional application No. 60/311,629, filed on Aug. 10, 2001.

(51) Int. Cl.[7] ..... H01P 1/387
(52) U.S. Cl. ..... 333/1.1; 333/24.2
(58) Field of Search ..... 333/1.1, 24.2

(56) References Cited

U.S. PATENT DOCUMENTS 3,339,158 A 8/1967 Passaro
3,701,054 A 10/1972 Hagler et al.
3,781,704 A 12/1973 De Gruyl
3,895,308 A * 7/1975 Lee et al. ..... 330/307
5,172,080 A * 12/1992 Fisher et al. ..... 333/1.1
5,638,033 A 6/1997 Walker et al. ..... 333/1.1
5,653,841 A 8/1997 Krishnamurthy et al. ... 156/150
6,107,895 A 8/2000 Butland et al. ..... 333/1.1

OTHER PUBLICATIONS

EPO Search Report of EP 02 25 5390, Dated Nov. 11, 2002.

* cited by examiner

*Primary Examiner*—Justin P. Bettendorf

(57) ABSTRACT

A compact dual element cascade circulator in which performance is enhanced while the size of the overall device is reduced. The circulator includes a plurality of junctions connected in cascade to provide a plurality of non-reciprocal transmission path between signal ports on a network, and a metal housing with a cover in which the junctions are disposed. The plurality of junctions includes a single oblong permanent magnet, a dual ferrite component including two (2) oblong ferrite elements, a dielectric constant medium disposed between the ferrite elements, and a plurality of conductor portions sandwiched between the ferrite elements. A single impedance matching structure is coupled between successive junctions. By configuring the dual element cascade circulator to include the single permanent magnet and the dual ferrite component that are employed by successive junctions of the circulator, and the single impedance matching structure coupled between the respective successive junctions, enhanced circulator performance and a reduced device size are achieved.

15 Claims, 10 Drawing Sheets

CASCADED CIRCULATORS WITH COMMON FERRITE AND COMMON ELEMENT MATCHING STRUCTURE

CROSS REFERENCE TO RELATED APPLICATIONS

This application claims priority of U.S. Provisional Patent Application No. 60/311,629 filed Aug. 10, 2001 entitled COMMON ELEMENT MATCHING STRUCTURE.

STATEMENT REGARDING FEDERALLY SPONSORED RESEARCH OR DEVELOPMENT

N/A

BACKGROUND OF THE INVENTION

The present invention relates generally to radio frequency and microwave circulators, and more specifically to a junction-type stripline circulator providing enhanced performance in a more compact device configuration.

Radio Frequency (RF) and microwave circulators are known that employ a DC-biasing magnetic field generated in ferrite material enveloping a conductor to provide at least one non-reciprocal transmission path between signal ports on a network. A conventional junction-type stripline circulator comprises at least one junction configured as an interface between the signal ports. Each junction of the junction-type stripline circulator typically includes two (2) permanent magnets, two (2) ground plane portions disposed between the magnets, two (2) ferrite disks disposed between the ground plane portions, a dielectric constant medium disposed between the ferrite disks, and a conductor sandwiched between the ferrite disks and patterned to correspond to the transmission paths between the signal ports. The permanent magnets are configured to generate a DC-biasing magnetic field in the ferrite disks, thereby providing the desired non-reciprocal operation of the transmission paths between the signal ports on the network.

One drawback of the conventional junction-type stripline circulator, particularly multi-junction stripline circulators comprising a plurality of junctions connected in cascade, is that it frequently exhibits degraded electrical performance. This is because the successive junctions of the multi-junction stripline circulator are typically interconnected by respective microstrip transmission lines. Further, an impedance matching structure is typically required at each junction-to-transmission line transition of the circulator. For example, a multi-junction stripline circulator comprising two (2) junctions may include a single transmission line interconnecting the junctions and two (2) impedance matching structures at respective ends of the transmission line. As a result, there is often significant sensitivity of the signal phase and Voltage Standing Wave Ratio (VSWR) amplitude between the junctions of the circulator. Moreover, such a junction-type stripline circulator configuration comprising a transmission line between successive junctions of the circulator and multiple impedance matching structures at the junction-to-transmission line transitions can significantly increase the size of the overall device.

It would therefore be desirable to have a junction-type stripline circulator that can be used in RF and microwave applications. Such a junction-type stripline circulator would be configured to provide enhanced performance in a smaller device configuration.

BRIEF SUMMARY OF THE INVENTION

In accordance with the present invention, a junction-type stripline circulator is provided in which performance is enhanced while the size of the overall device is reduced. Benefits of the presently disclosed invention are achieved by configuring the junction-type stripline circulator to include a single permanent magnet and a dual ferrite component that are employed by successive junctions of the circulator, and a single impedance matching structure coupled between the successive junctions of the circulator.

In one embodiment, the junction-type stripline circulator comprises a compact dual element cascade circulator including a plurality of junctions connected in cascade to provide a plurality of non-reciprocal transmission paths between signal ports on a network. The plurality of junctions comprises a single oblong permanent magnet, an oblong ground plane disposed near the permanent magnet, a dual ferrite component including two (2) oblong ferrite elements disposed near the ground plane, and a conductor sandwiched between the ferrite elements. A dielectric constant medium is disposed between the two (2) ferrite elements. Further, the conductor is patterned to correspond to the configuration of the transmission paths between the signal ports.

The conductor includes a plurality of conductor portions, and each junction of the dual element cascade circulator comprises a respective one of the conductor portions. Further, sections of the conductor between successive conductor portions are used to form single impedance matching structures for respective junction-to-junction transitions. In this embodiment, each impedance matching structure comprises a lumped reactance.

The dual element cascade circulator further includes a metal housing having an open top into which the plurality of junctions is disposed, and a metal cover configured to enclose the top of the housing to secure the junctions inside. The metal housing has a plurality of slots through which respective contact terminals of the conductor protrude to make contact with the signal ports on the network.

The plurality of junctions further comprises two (2) oblong pole pieces associated with the permanent magnet, and a cover return component. A first pole piece is disposed between the magnet and the ground plane, and a second pole piece is disposed between the base of the housing and the dual ferrite component. The cover return component is disposed between the cover and the permanent magnet.

In this embodiment, the combination of the ground plane, the dual ferrite component, and the conductor forms a Radio Frequency (RF) or microwave circuit configured to provide desired non-reciprocal transmission paths between the network signal ports. Further, the combination of the pole pieces, the permanent magnet, the metal housing, the cover return component, and the metal cover forms a magnetic circuit configured to generate a DC-biasing magnetic field in the dual ferrite component, thereby achieving the desired non-reciprocal operation of the transmission paths. Moreover, the two (2) pole pieces are configured to enhance the homogeneity of the magnetic field in the dual ferrite component, the cover return component is configured to provide an easy return path for the magnetic flux associated with the DC-biasing magnetic field from the ferrite elements to the permanent magnet, and each impedance matching structure is configured to avoid the reflection of energy between successive junctions of the circulator.

By configuring the compact dual element cascade circulator to include the single permanent magnet and the dual ferrite component that can be employed by successive junctions of the circulator, and the single impedance matching structure coupled between the respective successive junctions, the circulator achieves numerous benefits. For example, the performance of the dual element cascade circulator is enhanced. Particularly, by providing the single impedance matching structure between successive junctions, phase uniformity is improved, and both Voltage Standing Wave Ratio (VSWR) amplitude sensitivity and overall insertion loss are reduced. Other benefits include a more compact design due to the integral impedance matching structure, more consistent return loss values, more uniform DC-biasing magnetic fields, better power handling due to improved distribution of heat in the dual ferrite component, and quicker and more uniform magnetic field settings because the oblong permanent magnet design allows the use of a c-coil degausser, which generally cannot be used with conventional junction-type stripline circulator designs.

Other features, functions, and aspects of the invention will be evident from the Detailed Description of the Invention that follows.

BRIEF DESCRIPTION OF THE SEVERAL VIEWS OF THE DRAWING

The invention will be more fully understood with reference to the following Detailed Description of the Invention in conjunction with the drawings of which.

DETAILED DESCRIPTION OF THE INVENTION

U.S. Provisional Patent Application No. 60/311,629 filed Aug. 10, 2001 is incorporated herein by reference.

A junction-type stripline circulator is disclosed that provides enhanced performance in a more compact design configuration. In the presently disclosed junction-type stripline circulator, a single permanent magnet and a dual ferrite component are employed by successive junctions of the circulator, and a single impedance matching structure is coupled between the respective successive junctions, thereby reducing the sensitivity of the phase and Voltage Standing Wave Ratio (VSWR) amplitude between the junctions while reducing the size of the overall device.

Figure 1:
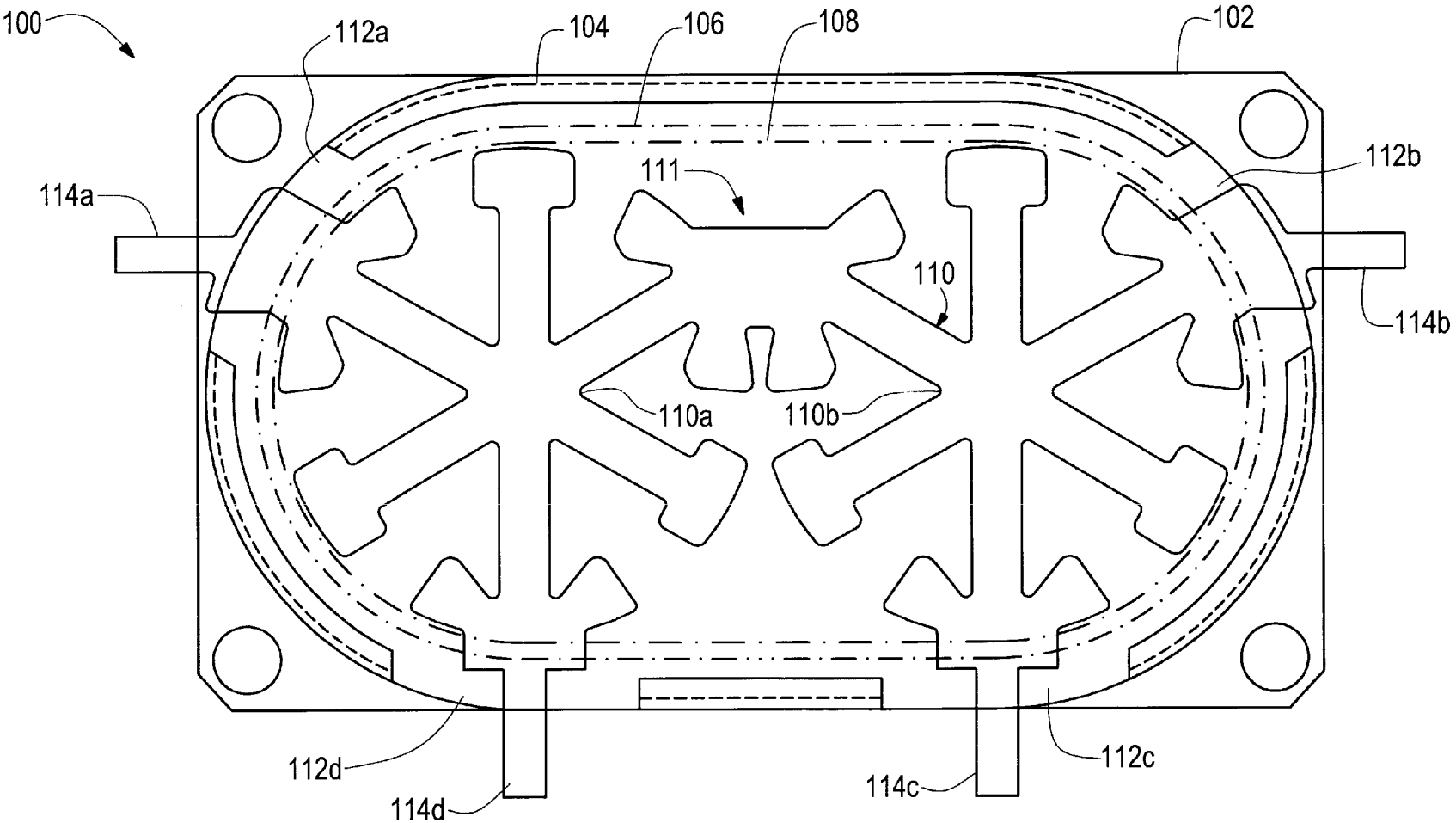
FIG. 1 is a plan view of a compact dual element cascade circulator according to the present invention.

FIG. 1 depicts a plan view of an illustrative embodiment of a compact dual element cascade circulator 100 configured to provide a plurality of non-reciprocal transmission paths between signal ports on a network (not shown), in accordance with the present invention. In the illustrated embodiment, the dual element cascade circulator 100 includes an oblong permanent magnet 106, a dual ferrite component 108, a center conductor 110 sandwiched between two (2) oblong ferrite elements of the ferrite component 108, and an oblong cover return component 104. The permanent magnet 106, the ferrite component 108, the center conductor 110, and the cover return component 104 are disposed in a metal housing 102 having an open top and a plurality of slots 112*a*–112*d* through which respective contact terminals 114*a*–114*d* of the center conductor 110 protrude to make contact with, e.g., four (4) signal ports (not shown) on the network.

For example, the center conductor 110 may be formed from a thin sheet of foil or copper, or any other suitable electrically conductive material. Further, the center conductor 110 may be patterned to correspond to the transmission paths between the signal ports by way of etching, stamping, photolithography, or any other suitable process.

It should be noted that the dual element cascade circulator 100 comprises two (2) junctions connected in cascade and configured as an interface between four (4) signal ports. Specifically, a first junction includes a center conductor portion 110*a,* and a second junction connected in cascade to the first junction at a common conductor section 111 includes a center conductor portion 110*b.* The permanent magnet 106, the ferrite elements of the ferrite component 108, and the cover return component 104 are configured to be shared by both the first and second junctions of the circulator 100. It is understood that the dual element cascade circulator 100 may be configured to accommodate one or more junctions to provide transmission paths between a desired number of network signal ports.

Figure 2:
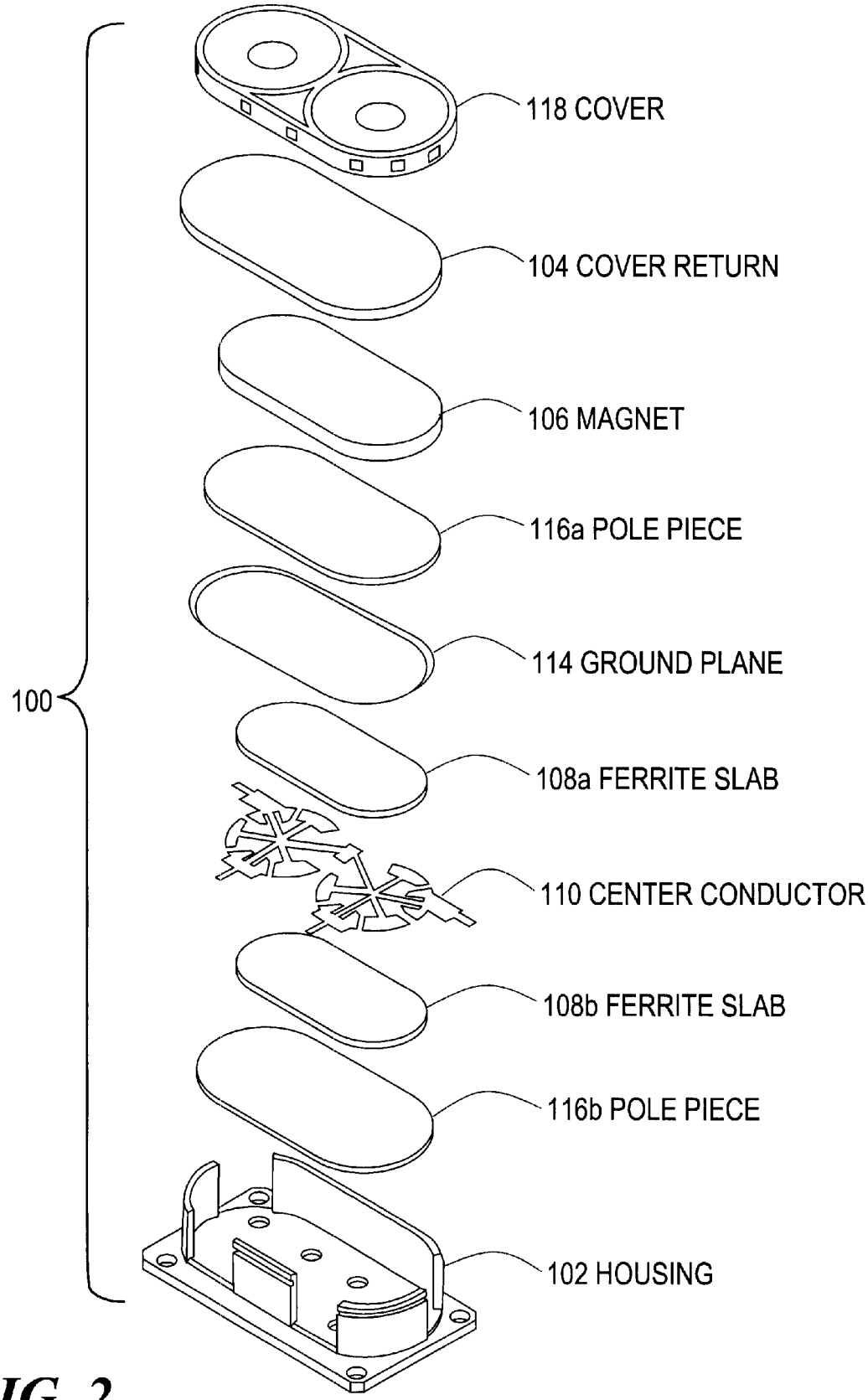
FIG. 2 is an exploded view of the dual element cascade circulator of FIG. 1.

FIG. 2 depicts an exploded view of the dual element cascade circulator 100 (see also FIG. 1). As shown in FIG. 2, the dual element cascade circulator 100 includes the permanent magnet 106, the ferrite component 108 comprising the ferrite elements 108*a* and 108*b,* the center conductor 110, the cover return component 104, and the metal housing 102.

Specifically, the permanent magnet 106 operates in conjunction with pole pieces 116*a* and 116*b,* which are configured to enhance the homogeneity of a DC-biasing magnetic field generated in the ferrite component 108 by the magnet 106. In the illustrated embodiment, the permanent magnet 106 is disposed between the cover return component 104 and the pole piece 116*a,* and the pole piece 116*b* is disposed between the ferrite element 108*b* and the base of the housing 102. It is understood that the DC-biasing magnetic field may alternatively be generated by a pair of permanent magnets or by an electromagnet.

The combination of the ferrite elements 108*a* and 108*b,* a dielectric constant medium (e.g., air) disposed between the ferrite elements 108*a* and 108*b,* the center conductor 110 sandwiched between the ferrite elements 108*a* and 108*b,* and a ground plane 114 disposed between the pole piece 116*a* and the ferrite element 108*a* forms a Radio Frequency (RF) or microwave circuit, which is configured to provide desired non-reciprocal transmission paths between the four (4) network signal ports when a suitable DC-biasing magnetic field is generated in the ferrite component 108. For example, the RF or microwave circuit may be configured to transmit power in forward directions along respective transmission paths extending from the contact terminal 114*a* to the contact terminal 114*d,* from the contact terminal 114*a* to the contact terminal 114*b,* and from the contact terminal 114*c* to the contact terminal 114*b,* while preventing the transmission of power in corresponding reverse directions (i.e., the contact terminal 114*d* is isolated from the contact terminal 114*a,* the contact terminal 114*b* is isolated from the contact terminal 114*a,* and the contact terminal 114*b* is isolated from the contact terminal 114*c*). It is understood that the RF or microwave circuit may be configured to transmit power in forward directions and prevent such transmission in corresponding reverse directions along alternative non-reciprocal transmission paths between the network signal ports.

Moreover, the combination of the pole pieces 116*a* and 116*b,* the permanent magnet 106, the metal housing 102, the cover return component 104, and a metal cover 118 forms a magnetic circuit, which is configured to generate the suitable DC-biasing magnetic field in the ferrite component 108 between the pole pieces 116*a* and 116*b*. The cover return component 104 is configured to provide an easy return path for the magnetic flux associated with the DC-biasing magnetic field from the ferrite elements 108*a* and 108*b* back to the permanent magnet 106.

For example, the metal housing 102 and the metal cover 118 may be made of iron, steel, or any other suitable ferromagnetic material capable of completing the magnetic circuit between the pole pieces 116*a* and 116*b*.

As described above, the dual element cascade circulator 100 comprises the first junction including the center conductor portion 110*a* and the second junction including the center conductor portion 110*b,* in which the common conductor section 111 interconnects the center conductor portions 110*a* and 110*b*. Specifically, the common conductor section 111, in combination with the ferrite elements 108*a* and 108*b,* the dielectric constant medium between the ferrite elements 108*a* and 108*b,* and the ground plane 114 of the RF or microwave circuit, is configured to provide a single impedance matching structure for the junction-to-junction transition. In the illustrated embodiment, the single impedance matching structure comprises a lumped reactance. For example, the lumped reactance may be suitably configured to obtain any capacitive or inductive reactance needed to avoid the reflection of energy between the successive junctions. In a preferred embodiment, the lumped reactance is configured to provide an impedance of about 50Ω at the junction-to-junction transition. It is noted that the single impedance matching structure may alternatively comprise a lumped capacitance.

Figure 3A:
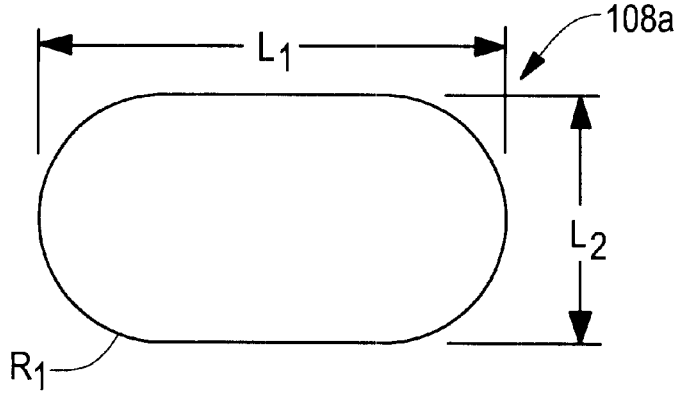
FIG. 3*a* is a plan view of a dual ferrite component included in the dual element cascade circulator of FIG. 1.

FIG. 3*a* depicts a plan view of the ferrite element 108*a* included in the dual element cascade circulator 100 (see FIGS. 1 and 2). It should be understood that the ferrite element 108*b* (see FIGS. 1 and 2) has a configuration similar to that of the ferrite element 108*a*. For example, the material used to make the ferrite elements 108*a* and 108*b* may be TTVG-1200 or any other suitable material. In a preferred embodiment, the dimension $L_1$ is about 1.400 inches, the dimension $L_2$ is about 0.690 inches, and the radius $R_1$ is about 0.345 radians. Further, the surface finish dimensions of the ferrite component 108 are preferably less than about 20 $\mu$inches.

Figure 3B:
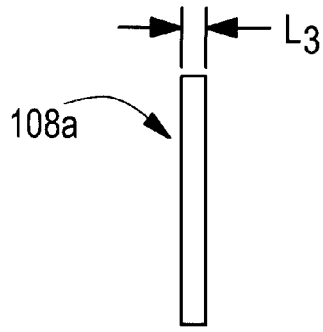
FIG. 3*b* is a side view of the dual ferrite component of FIG. 3*a;*

FIG. 3*b* depicts a side view of the ferrite element 108*a* shown in FIG. 3*a*. In a preferred embodiment, the dimension $L_3$ is about 0.040 inches.

Figure 4A:
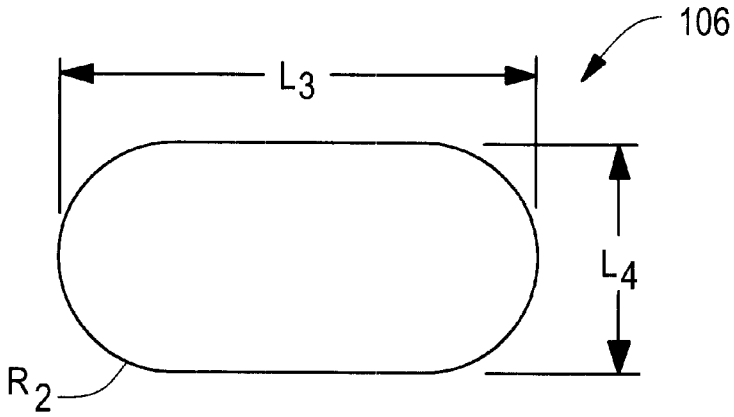
FIG. 4*a* is a plan view of an oblong permanent magnet included in the dual element cascade circulator of FIG. 1.

FIG. 4*a* depicts a plan view of the permanent magnet 106 included in the dual element cascade circulator 100 (see FIG. 1). For example, the material used to make the permanent magnet 106 may comprise anisotropic ceramic 8 (barium ferrite) or SSR-360H according to the Magnetic Materials Producers Associates (MMPA) standard specifications, or any other suitable material. In a preferred embodiment, the dimension $L_3$ is about 1.446 inches, the dimension $L_4$ is about 0.735 inches, and the radius $R_2$ is about 0.367 radians.

Figure 4B:
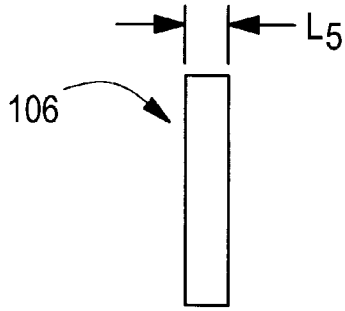
FIG. 4*b* is a side view of the oblong permanent magnet of FIG. 4*a;*

FIG. 4*b* depicts a side view of the permanent magnet 106. In a preferred embodiment, the dimension $L_5$ is about 0.150 inches. Moreover, the indication "—0—" shown in FIG. 4*b* designates the magnetic orientation of the permanent magnet 106.

Figure 5A:
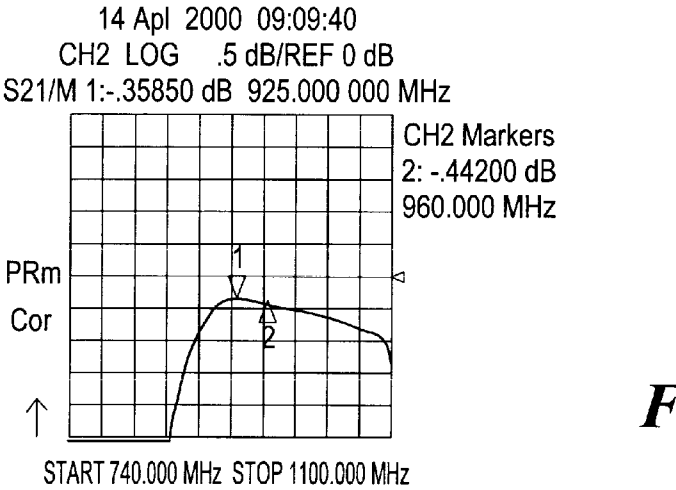
FIGS. 5*a*–5*b* are plots representing power transmission versus frequency at a first pair of contact terminals of the dual element cascade circulator of FIG. 1.
Figure 5B:
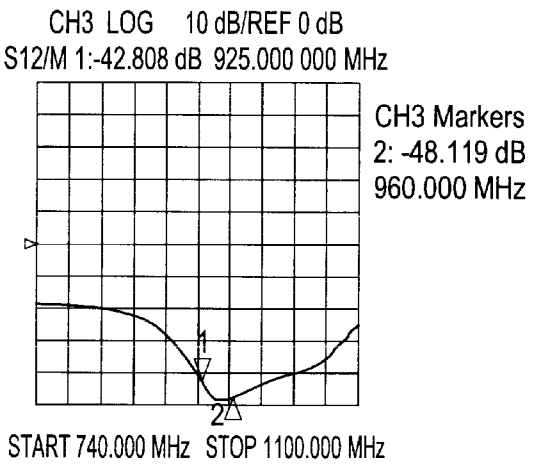

FIGS. 5*a*–5*b* depict plots representing power transmission versus frequency at the contact terminals 114*a* and 114*b* of the dual element cascade circulator 100 (see FIG. 1). In this graphical representation, the RF or microwave circuit of the circulator 100 is configured to transmit power in a forward direction from the contact terminal 114*a* to the contact terminal 114*b,* and to provide isolation in a corresponding reverse direction from the contact terminal 114*b* to the contact terminal 114*a*. Accordingly, the plot of FIG. 5*a* shows maximum power transmission at the contact terminal 114*b* at about the center frequency of an exemplary operating frequency range of 740 MHz to 1100 MHz. Further, the plot of FIG. 5*b* shows minimum power transmission in a corresponding reverse direction (i.e., maximum isolation) at the contact terminal 114*a* at about the center frequency of the exemplary operating frequency range.

Figure 5C:
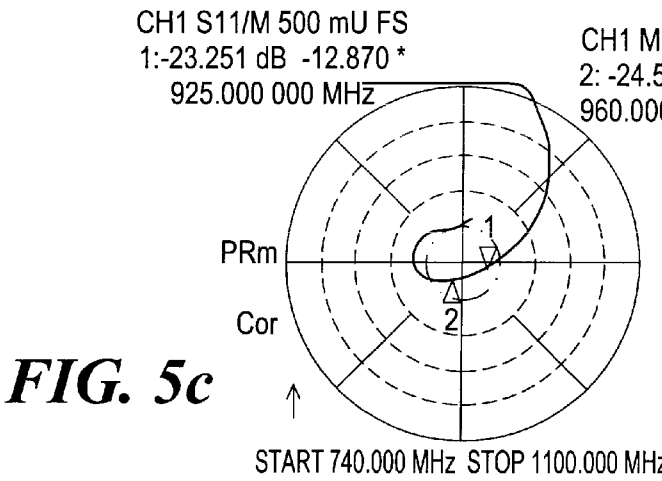
FIGS. 5*c*–5*d* are Smith chart plots representing impedance versus frequency at the contact terminal pair of FIGS. 5*a*–5*b;*
Figure 5D:
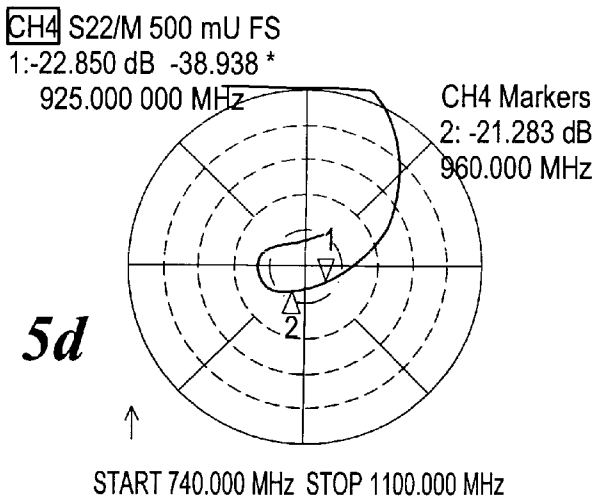

FIGS. 5*c*–5*d* depict Smith chart plots representing impedance versus frequency, as viewed from the contact terminals 114*a* and 114*b,* respectively. As shown in FIGS. 5*c*–5*d,* the respective impedance values approach 50Ω near the center frequency of the above-defined exemplary operating frequency range.

Figure 6A:
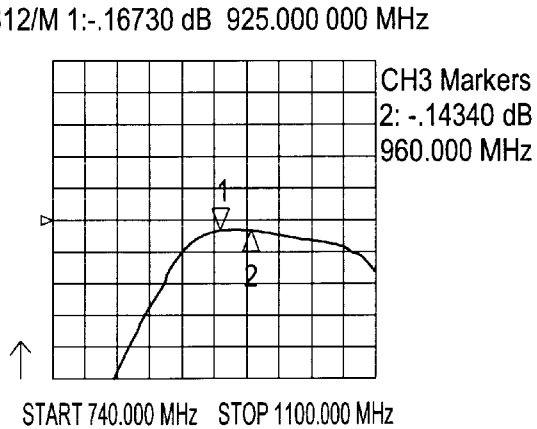
FIGS. 6*a*–6*b* are plots representing power transmission versus frequency at a second pair of contact terminals of the dual element cascade circulator of FIG. 1.
Figure 6B:
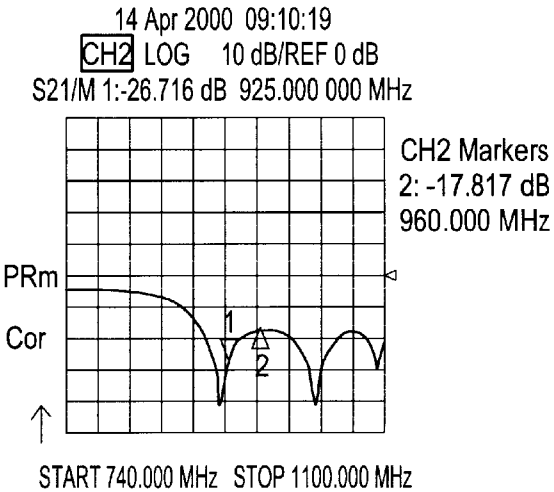

FIGS. 6*a*–6*b* depict plots representing power transmission versus frequency at the contact terminals 114*a* and 114*d* of the dual element cascade circulator 100 (see FIG. 1). In this graphical representation, the RF or microwave circuit of the circulator 100 is configured to provide isolation from the contact terminal 114*a* to the contact terminal 114*d,* and to provide maximum power from the contact terminal 114*d* to the contact terminal 114*a*. Accordingly, the plot of FIG. 6*a* shows maximum power transmission at the contact terminal

114*a* at about the center frequency of the above-defined exemplary operating frequency range, and the plot of FIG. 6*b* shows minimum power transmission (i.e., maximum isolation) at the contact terminal 114*d* at about the center frequency of the exemplary operating frequency range.

Figure 6C:
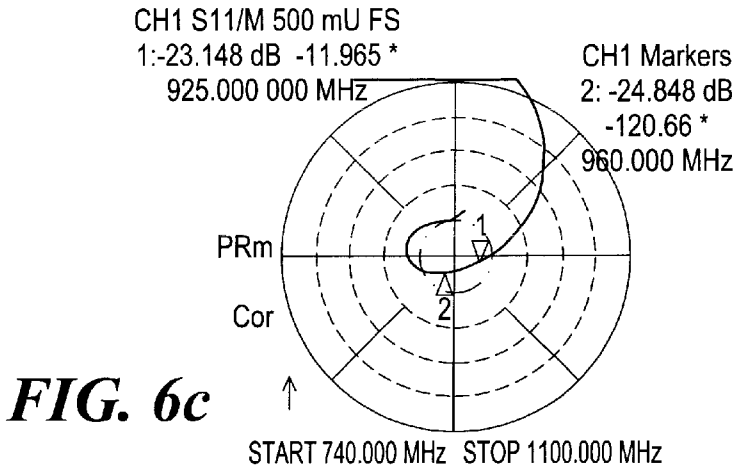
FIGS. 6*c*–6*d* are Smith chart plots representing impedance versus frequency at the contact terminal pair of FIGS. 6*a*–6*b;*
Figure 6D:
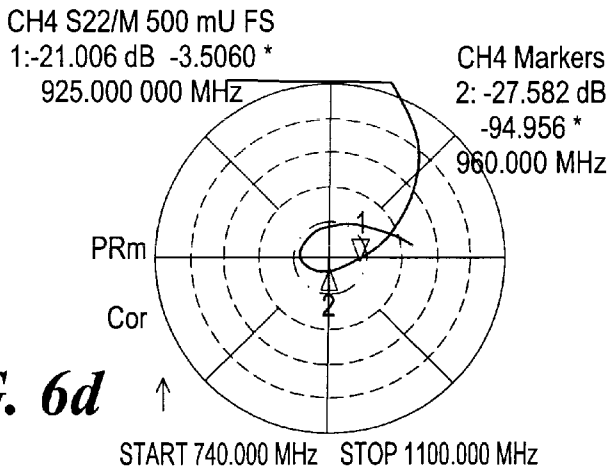

FIGS. 6*c*–6*d* depict Smith chart plots representing impedance versus frequency, as viewed from the contact terminals 114*a* and 114*d,* respectively. As shown in FIGS. 6*c*–6*d,* the respective impedance values approach 50Ω near the center frequency of the above-defined exemplary operating frequency range.

Figure 7A:
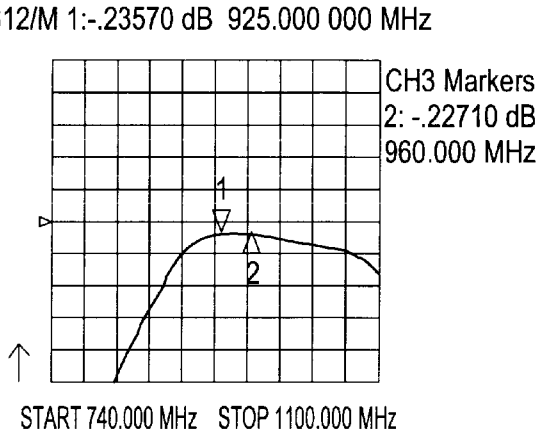
FIGS. 7*a*–7*b* are plots representing power transmission versus frequency at a third pair of contact terminals of the dual element cascade circulator of FIG. 1.
Figure 7B:
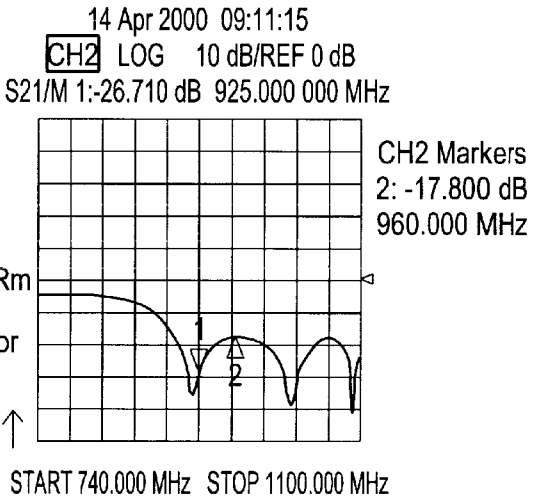

FIGS. 7*a*–7*b* depict plots representing power transmission versus frequency at the contact terminals 114*c* and 114*b* of the dual element cascade circulator 100 (see FIG. 1). In this graphical representation, the RF or microwave circuit of the circulator 100 is configured to transmit power in a direction from the contact terminal 114*b* to the contact terminal 114*c,* and to provide isolation in a corresponding reverse direction from the contact terminal 114*c* to the contact terminal 114*b.* Accordingly, the plot of FIG. 7*a* shows maximum power transmission at the contact terminal 114*c* at about the center frequency of the above-defined exemplary operating frequency range, and the plot of FIG. 7*b* shows minimum power transmission (i.e., maximum isolation) at the contact terminal 114*b* at about the center frequency of the exemplary operating frequency range.

Figure 7C:
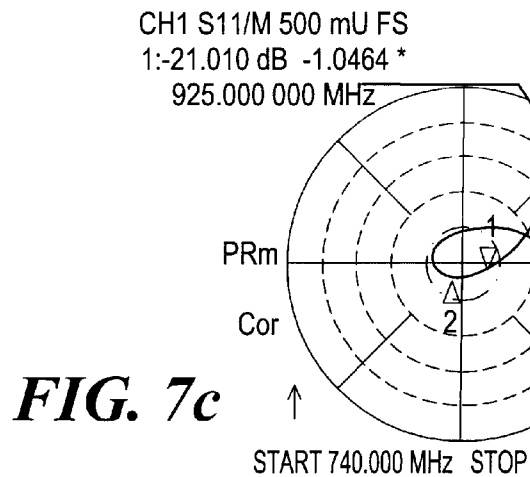
FIGS. 7*c*–7*d* are Smith chart plots representing impedance versus frequency at the contact terminal pair of FIGS. 7*a*–7*b;*
Figure 7D:
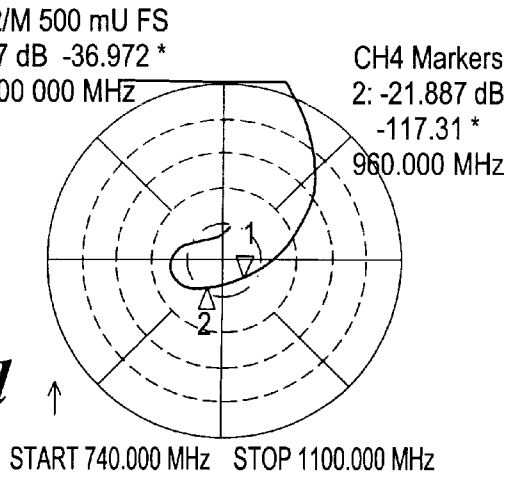

FIGS. 7*c*–7*d* depict Smith chart plots representing impedance versus frequency, as viewed from the contact terminals 114*c* and 114*b,* respectively. As shown in FIGS. 7*c*–7*d,* the respective impedance values approach 50Ω near the center frequency of the above-defined exemplary operating frequency range.

Figure 8:
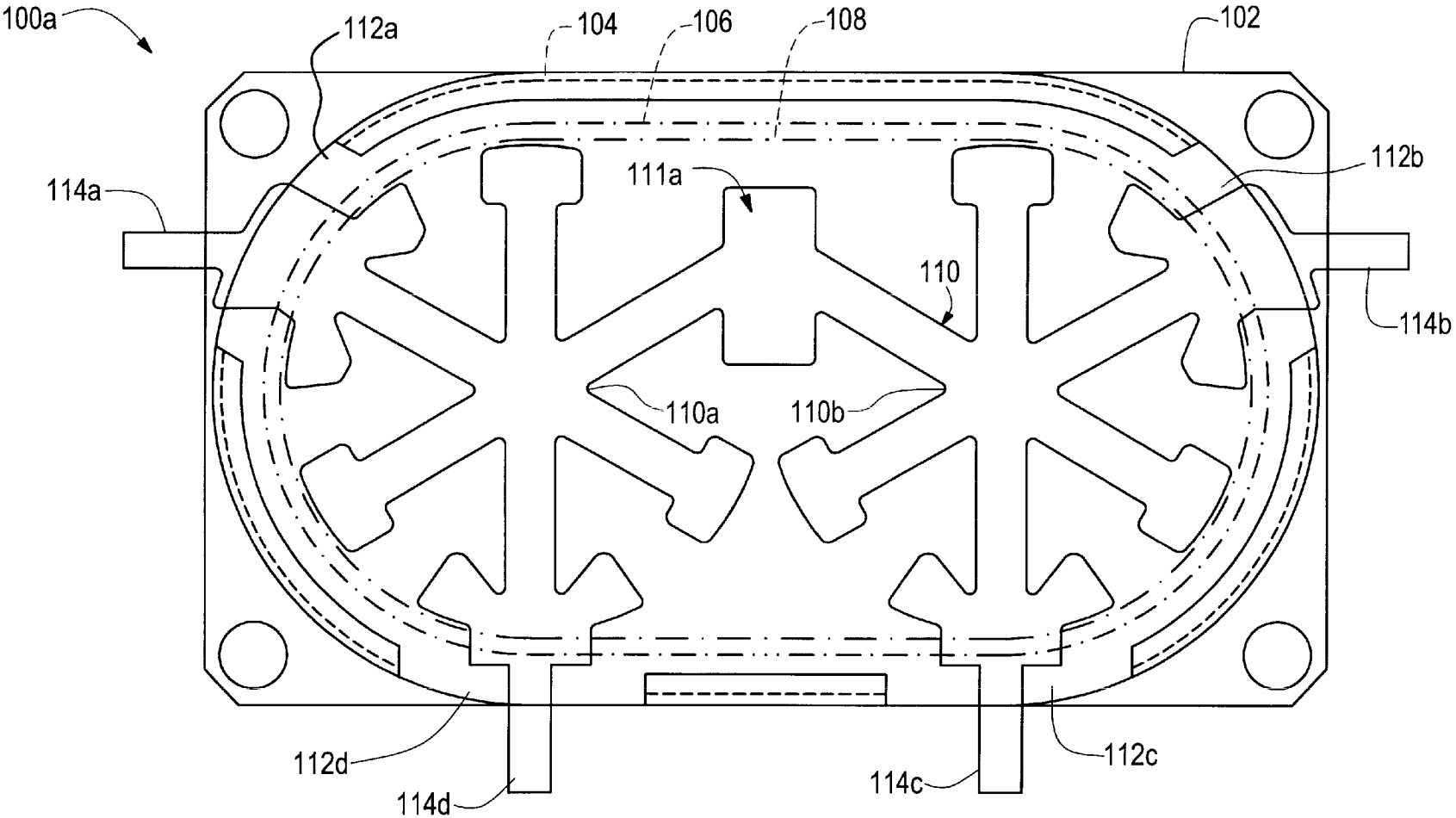
FIG. 8 is a plan view of an alternative embodiment of a compact dual element cascade circulator according to the present invention.

FIG. 8 depicts a plan view of an alternative embodiment of a compact dual element cascade circulator 100*a* configured to provide a plurality of non-reciprocal transmission paths between signal ports on a network (not shown), in accordance with the present invention. The dual element cascade circulator 100*a* is like the dual element cascade circulator 100 with the exception that the common conductor section 111 (see FIG. 1) of the circulator 100 is replaced by an alternative common conductor section 111*a* (see FIG. 8).

Figure 9B:
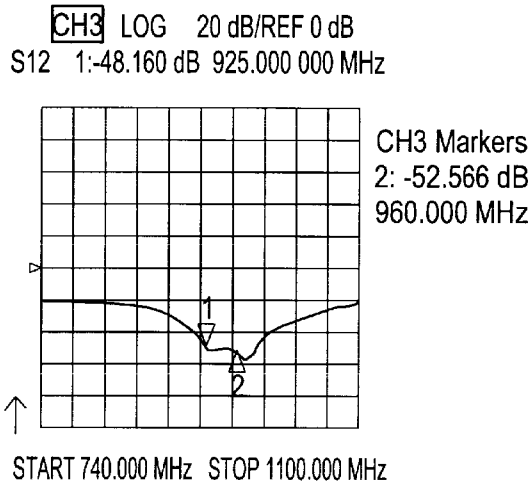
FIGS. 9*a*–9*b* are plots representing power transmission versus frequency at a first pair of contact terminals of the dual element cascade circulator of FIG. 8.
Figure 9D:
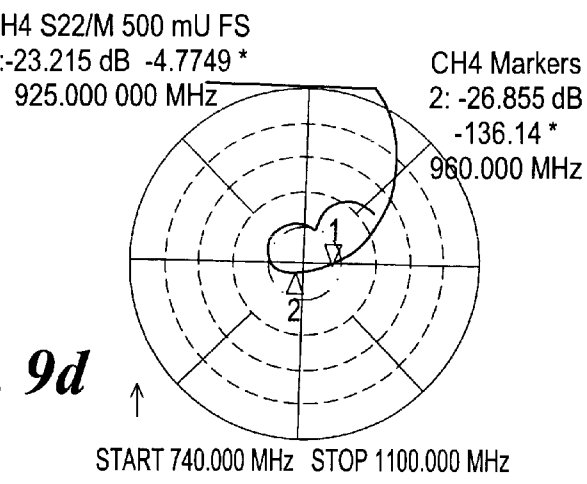
FIGS. 9*c*–9*d* are Smith chart plots representing impedance versus frequency at the contact terminal pair of FIGS. 9*a*–9*b;*
Figure 9A:
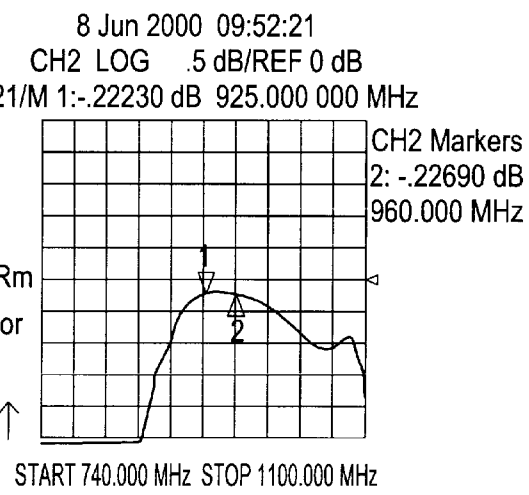

FIGS. 9*a*–9*b* depict plots representing power transmission versus frequency at the contact terminals 114*a* and 114*b* of the dual element cascade circulator 100*a* (see FIG. 8). In this graphical representation, the RF or microwave circuit of the circulator 100*a* is configured to transmit power in a forward direction from the contact terminal 114*a* to the contact terminal 114*b,* and to provide isolation in a corresponding reverse direction from the contact terminal 114*b* to the contact terminal 114*a.* Accordingly, the plot of FIG. 9*a* shows maximum power transmission at the contact terminal 114*b* at about the center frequency of the exemplary operating frequency range of 740 MHz to 1100 MHz. Further, the plot of FIG. 9*b* shows minimum power transmission (i.e., maximum isolation) at the contact terminal 114*a* at about the center frequency of the exemplary operating frequency range.

Figure 9C:
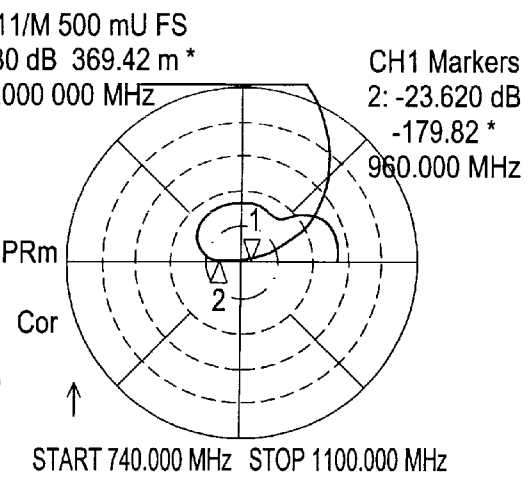

FIGS. 9*c*–9*d* depict Smith chart plots representing impedance versus frequency, as viewed from the contact terminals 114*a* and 114*b,* respectively. As shown in FIGS. 9*c*–9*d,* the respective impedance values approach 50Ω near the center frequency of the above-defined exemplary operating frequency range.

Figure 10A:
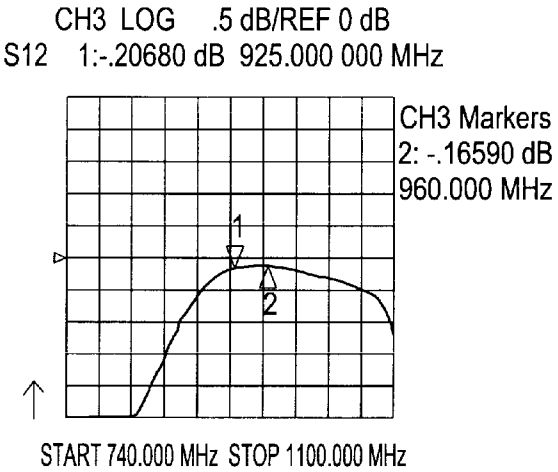
FIGS. 10*a*–10*b* are plots representing power transmission versus frequency at a second pair of contact terminals of the dual element cascade circulator of FIG. 8.
Figure 10B:
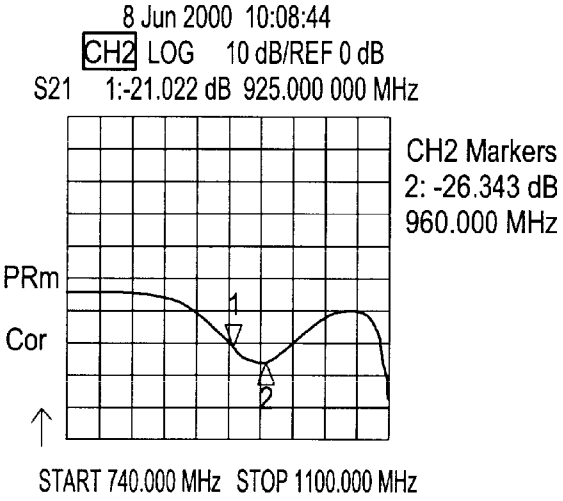

FIGS. 10*a*–10*b* depict plots representing power transmission versus frequency at the contact terminals 114*a* and 114*d* of the dual element cascade circulator 100*a* (see FIG. 8). In this graphical representation, the RF or microwave circuit of the circulator 100*a* is configured to transmit power in a direction from the contact terminal 114*d* to the contact terminal 114*a,* and to provide isolation in a corresponding reverse direction from the contact terminal 114*a* to the contact terminal 114*d.* Accordingly, the plot of FIG. 10*a* shows maximum power transmission at the contact terminal 114*a* at about the center frequency of the above-defined exemplary operating frequency range, and the plot of FIG. 10*b* shows minimum power transmission (i.e., maximum isolation) at the contact terminal 114*d* at about the center frequency of the exemplary operating frequency range.

Figure 10C:
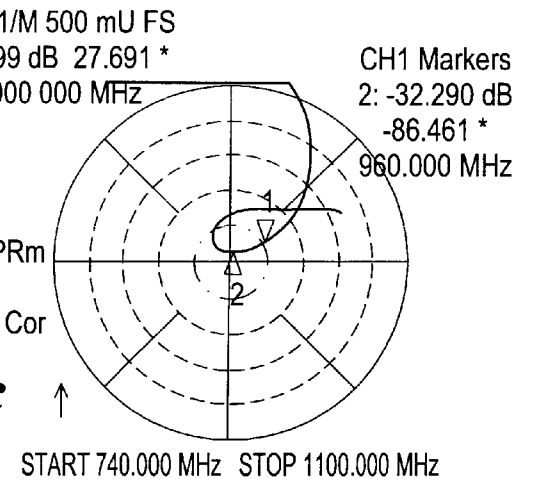
FIGS. 10*c*–10*d* are Smith chart plots representing impedance versus frequency at the contact terminal pair of FIGS. 10*a*–10*b;*
Figure 10D:
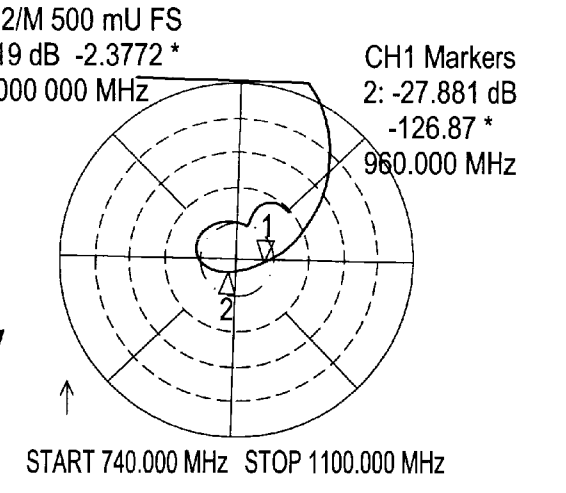

FIGS. 10*c*–10*d* depict Smith chart plots representing impedance versus frequency, as viewed from the contact terminals 114*a* and 114*d,* respectively. As shown in FIGS. 10*c*–10*d,* the respective impedance values approach 50Ω near the center frequency of the above-defined exemplary operating frequency range.

Figure 11A:
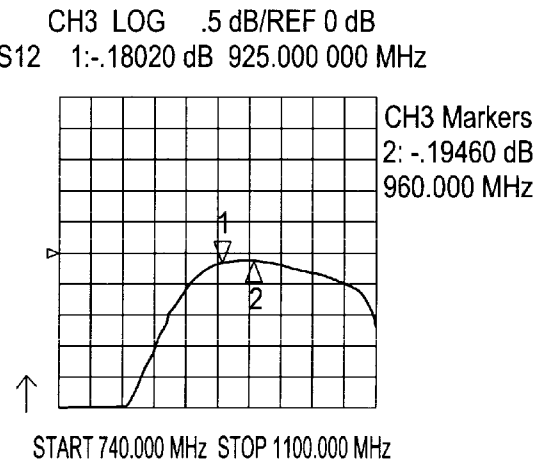
FIGS. 11*a*–11*b* are plots representing power transmission versus frequency at a third pair of contact terminals of the dual element cascade circulator of FIG. 8.
Figure 11B:
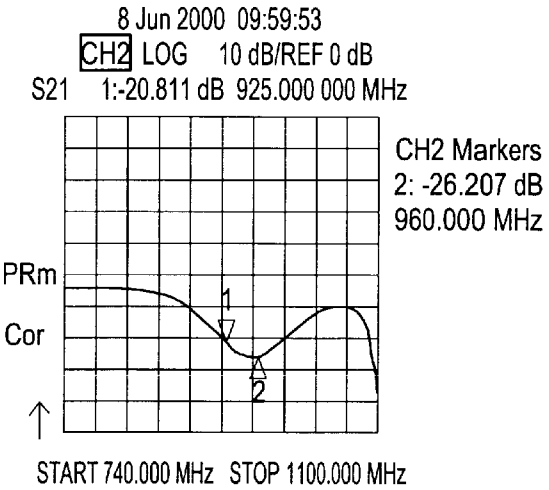

FIGS. 11*a*–11*b* depict plots representing power transmission versus frequency at the contact terminals 114*b* and 114*c* of the dual element cascade circulator 100*a* (see FIG. 8). In this graphical representation, the RF or microwave circuit of the circulator 100*a* is configured to transmit power in a direction from the contact terminal 114*b* to the contact terminal 114*c,* and to provide isolation in a corresponding reverse direction from the contact terminal 114*c* to the contact terminal 114*b.* Accordingly, the plot of FIG. 11*a* shows maximum power transmission at the contact terminal 114*c* at about the center frequency of the above-defined exemplary operating frequency range, and the plot of FIG. 11*b* shows minimum power transmission (i.e., maximum isolation) at the contact terminal 114*b* at about the center frequency of the exemplary operating frequency range.

Figure 11C:
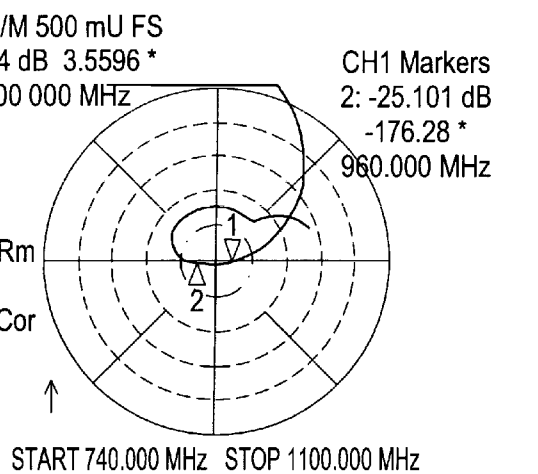
FIGS. 11*c*–11*d* are Smith chart plots representing impedance versus frequency at the contact terminal pair of FIGS. 11*a*–11*b.*
Figure 11D:
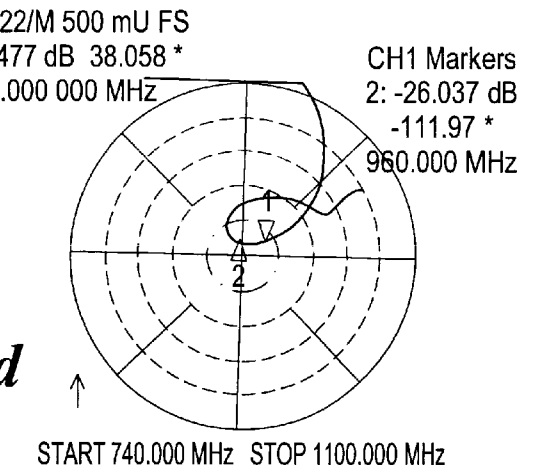

FIGS. 11*c*–11*d* depict Smith chart plots representing impedance versus frequency, as viewed from the contact terminals 114*c* and 114*b,* respectively. As shown in FIGS. 11*c*–11*d,* the respective impedance values approach 50Ω near the center frequency of the above-defined exemplary operating frequency range.

It will be appreciated that by configuring the compact dual element cascade circulator 100 (see FIGS. 1 and 2) to include the single permanent magnet and the dual ferrite component that can be shared by successive junctions of the circulator 100, and the single impedance matching structure coupled between the respective successive junctions, the performance of the circulator 100 is enhanced. Specifically, phase uniformity is improved, and both the VSWR amplitude sensitivity and overall insertion loss are reduced. Further, the size of the overall device comprising the dual element cascade circulator 100 is reduced compared to conventional junction-type stripline circulator configurations.

It will further be appreciated by those of ordinary skill in the art that modifications to and variations of the above-described common element matching structure may be made without departing from the inventive concepts disclosed herein. Accordingly, the invention should not be viewed as limited except as by the scope and spirit of the appended claims.

What is claimed is:

1. A radio frequency/microwave junction-type circulator, comprising:

a plurality of signal ports;

a plurality of junctions connected in cascade and configured to provide a plurality of transmission paths between the signal ports, each junction including a conductor element patterned to correspond to at least a portion of the plurality of transmission paths;

a single impedance matching structure disposed at each connection between successive ones of the plurality of junctions;

at least one ferrite component configured to overlay the plurality of junctions; and at least one permanent magnet arranged in relation to the at least one ferrite component so as to generate a magnetic field in the ferrite component, thereby causing non-reciprocal operation of the plurality of transmission paths between the signal ports.

2. The circulator of claim 1 wherein the conductor elements comprise corresponding portions of a single conductor component and the connection between successive junctions comprises a common conductor section integral with the conductor component.

3. The circulator of claim 2 further including a ground plane disposed between the ferrite component and the permanent magnet, and wherein the single impedance matching structure comprises the common conductor section in combination with the ferrite component and the ground plane.

4. The circulator of claim 1 wherein the single impedance matching structure comprises a lumped reactance.

5. The circulator of claim 1 wherein the single impedance matching structure comprises a lumped capacitance.

6. The circulator of claim 1 wherein the ferrite component comprises two ferrite elements and the conductor elements are sandwiched between the two ferrite elements.

7. The circulator of claim 6 further including a dielectric constant medium disposed between the ferrite elements and a ground plane disposed between the ferrite component and the permanent magnet.

8. The circulator of claim 7 wherein the ferrite elements, the dielectric constant medium, the conductor elements, and the ground plane are arranged in relation to each other so as to form a radio frequency/microwave circuit for causing the non-reciprocal operation of the transmission paths when the magnetic field is generated in the ferrite component.

9. The circulator of claim 1 wherein the plurality of junctions, the ferrite component, and the permanent magnet are disposed in a metal housing.

10. The circulator of claim 9 wherein the metal housing includes a cover and a base portion and the circulator further comprises a first pole piece disposed between the permanent magnet and the ferrite component, a second pole piece disposed between the base portion of the housing and the conductor elements, and a cover return component disposed between the housing cover and the permanent magnet.

11. The circulator of claim 10 wherein the first and second pole pieces, the permanent magnet, the metal housing, and the cover return component are arranged in relation to each other so as to form a magnetic circuit for generating the magnetic field in the ferrite component.

12. A method of manufacturing a radio frequency/microwave junction-type circulator, comprising the steps of:

providing a plurality of junctions connected in cascade and configured to form a plurality of transmission paths between a plurality of signal ports, each junction including a conductor element patterned to correspond to at least a portion of the plurality of transmission paths, successive ones of the conductor elements being interconnected by a common conductor section;

providing a ferrite component configured to overlay the plurality of junctions;

providing a permanent magnet arranged in relation to the ferrite component so as to generate a magnetic field in the ferrite component, thereby causing non-reciprocal operation of the transmission paths between the plurality of signal ports; and providing a ground plane disposed between the ferrite component and the permanent magnet, wherein the common conductor section, the ferrite component, and the ground plane are arranged in relation to each other so as to form a single impedance matching structure at each connection between successive ones of the plurality of junctions.

13. The method of claim 12 further including the step of disposing the plurality of junctions, the ferrite component, and the permanent magnet in a metal housing.

14. The method of claim 13 further including the steps of providing a first pole piece disposed between the permanent magnet and the ferrite component, providing a second pole piece disposed between a base portion of the metal housing and the conductor elements, and providing a cover return component disposed between a cover of the metal housing and the permanent magnet.

15. The method of claim 12 further including the steps of providing a dielectric constant medium between first and second ferrite elements of the ferrite component.

* * * * *